US010337532B2

(12) United States Patent
Ma et al.

(10) Patent No.: US 10,337,532 B2
(45) Date of Patent: Jul. 2, 2019

(54) SPLIT SPOOL VALVE

(71) Applicant: Caterpillar Inc., Peoria, IL (US)

(72) Inventors: Pengfei Ma, Naperville, IL (US); Aleksandar Egelja, Naperville, IL (US); Justin Speichinger, Edwards, IL (US); Shuhei Orimoto, Koube (JP); Tetsuya Yoshino, Akashi (JP); Hideki Nakajima, Peoria, IL (US); Shogo Tada, Peoria, IL (US); Aleem Junaidi, Peoria, IL (US); Bryan Johnson, Montgomery, IL (US); Matthew Beschorner, Plainfield, IL (US)

(73) Assignee: Caterpillar Inc., Deerfield, IL (US)

( * ) Notice: Subject to any disclaimer, the term of this patent is extended or adjusted under 35 U.S.C. 154(b) by 157 days.

(21) Appl. No.: 15/367,675

(22) Filed: Dec. 2, 2016

(65) Prior Publication Data

US 2018/0156244 A1 Jun. 7, 2018

(51) Int. Cl.

| | |
|---|---|
| ***F15B 13/04*** | (2006.01) |
| ***F15B 11/08*** | (2006.01) |
| ***F15B 13/02*** | (2006.01) |
| ***F15B 21/14*** | (2006.01) |
| ***F15B 1/26*** | (2006.01) |
| ***F15B 13/044*** | (2006.01) |

(Continued)

(52) U.S. Cl.

CPC ..... *F15B 13/0402* (2013.01); *F15B 1/26* (2013.01); *F15B 11/003* (2013.01); *F15B 11/024* (2013.01); *F15B 11/08* (2013.01); *F15B 13/021* (2013.01); *F15B 13/024* (2013.01); *F15B 13/044* (2013.01); *F15B 13/0442* (2013.01); *F15B 21/14* (2013.01); *F15B 2011/0246* (2013.01); *F15B 2211/50* (2013.01)

(58) Field of Classification Search

CPC ..... F15B 11/003; F15B 11/024; F15B 2011/0246; F15B 13/01; F15B 13/021; F15B 13/044; F15B 13/0442

USPC ..... 91/465

See application file for complete search history.

(56) References Cited

U.S. PATENT DOCUMENTS 4,526,085 A * 7/1985 Morizur ..... E02F 9/2239 91/6

5,138,838 A * 8/1992 Crosser ..... F15B 21/087 60/426

5,568,759 A 10/1996 Aardema (Continued)

FOREIGN PATENT DOCUMENTS

EP 1710446 A1 10/2006

*Primary Examiner* — Michael Leslie

(74) *Attorney, Agent, or Firm* — Miller, Matthias & Hull

(57) ABSTRACT

A hydraulic system is disclosed. The hydraulic system may include a source of pressurized fluid; a tank; a hydraulic actuator including a first chamber and a second chamber; a first independent metering valve disposed between and fluidly connected to the source, the tank, and the first chamber of the hydraulic actuator; and a second independent metering valve disposed between and fluidly connected to the source, the tank, and the second chamber of the hydraulic actuator. Each of the first independent metering valve and the second independent metering valve may include a spool and a valve actuator disposed on one side of the spool. The valve actuator may include a push coil, a pull coil, and a force feedback mechanism configured to balance a force of the push coil and the pull coil.

20 Claims, 6 Drawing Sheets

(51) Int. Cl.
*F15B 11/00* (2006.01)
*F15B 11/024* (2006.01)

(56) References Cited

U.S. PATENT DOCUMENTS

| | | | | |
|---|---|---|---|---|
| 5,664,477 | A * | 9/1997 | Koehler | F15B 20/002 137/596.12 |
| 6,598,391 | B2 | 7/2003 | Lunzman et al. | |
| 6,883,313 | B2 | 4/2005 | Egelja et al. | |
| 7,487,707 | B2 * | 2/2009 | Pfaff | F15B 11/003 91/437 |
| 7,565,801 | B2 * | 7/2009 | Tozawa | E02F 9/2075 60/414 |
| 7,621,211 | B2 | 11/2009 | Ma et al. | |
| 8,434,516 | B2 * | 5/2013 | Aranovich | F15B 13/0402 137/625.67 |
| 8,631,650 | B2 | 1/2014 | Verkuilen et al. | |
| 8,695,333 | B2 * | 4/2014 | Vigholm | E02F 9/2217 60/461 |
| 9,194,107 | B2 | 11/2015 | Andruch, III et al. | |
| 2004/0011192 | A1 | 1/2004 | Fiat | |
| 2008/0034957 | A1 | 2/2008 | Husco | |
| 2016/0069360 | A1 | 3/2016 | Danfoss | |

* cited by examiner

SPLIT SPOOL VALVE

FIELD OF THE DISCLOSURE

The present disclosure relates generally to machines and, more particularly, to hydraulic systems for machines.

BACKGROUND OF THE DISCLOSURE

Machines, such as earthmoving and construction machines, generally include an engine that powers some type of hydraulic system. The hydraulic system may provide functionality and control to various aspects of the machines. For example, some machines employ a hydraulic system for propelling the machine and/or providing hydraulic power to work implements of the machine, such as linkages, buckets, shovels, and other tools. The hydraulic system may typically include one or more pumps used to convert mechanical power from the engine into hydraulic power.

The pump may be connected to a hydraulic actuator and may provide pressurized fluid to one or more fluid chambers of the hydraulic actuator. Hydraulic actuators, such as pistons/cylinders and fluid motors, are commonly used to move the work implements. More specifically, each hydraulic actuator typically includes at least two fluid chambers that are disposed on opposite sides of a movable element. The movable element is, in turn, connected to the work implement. These hydraulic systems may include an electrohydraulic valve arrangement that selectively connects the pump with one of the fluid chambers of the hydraulic actuator.

For instance, to move the work implement in a certain direction, the electrohydraulic valve arrangement is controlled so that pressurized fluid is provided to one chamber of the hydraulic actuator at the same time fluid is allowed to flow out of the other chamber. This creates a pressure differential over the movable element of the hydraulic actuator. When the force exerted on the movable element is greater enough to overcome the resistant force of the work implement, the movable element will move towards the area of lower fluid pressure existing in the opposite chamber of the hydraulic actuator, thereby moving the work implement. A control lever, or other type of operator control, may govern the motion of the work implement.

However, a cost of the electrohydraulic valve arrangement may be expensive with complex systems requiring numerous pieces of hardware.

A hydraulic system and method are disclosed in U.S. Pat. No. 9,194,107, entitled, "Regenerative Hydraulic Systems and Methods of Use." In the '107 patent, the hydraulic systems are capable of controlling the operation of multiple actuators, particular examples of which are linear and rotary actuators. The '107 systems contain distributed valves systems and one or more positive displacement units having both pumping and motoring modes. In particular, the '107 systems enable valves and actuators within the systems to reconfigure themselves so that flow from assistive loads on one or more actuators can be used to move one or more other actuators subjected to a resistive load.

While arguably effective, there is still a need for a hydraulic system with a cost-effective electrohydraulic valve arrangement that provides independent metering.

SUMMARY OF THE DISCLOSURE

In accordance with one aspect, a hydraulic system is disclosed. The hydraulic system may include a source of pressurized fluid; a tank; a hydraulic actuator including a first chamber and a second chamber; a first independent metering valve disposed between and fluidly connected to the source, the tank, and the first chamber of the hydraulic actuator; and a second independent metering valve disposed between and fluidly connected to the source, the tank, and the second chamber of the hydraulic actuator. Each of the first independent metering valve and the second independent metering valve may include a spool and a valve actuator disposed on one side of the spool. The valve actuator may include a push coil configured to push the spool in a first direction, a pull coil configured to pull the spool in a second direction opposite the first direction, and a force feedback mechanism configured to balance a force of the push coil and the pull coil.

In accordance with another aspect, a machine is disclosed. The machine may include an implement and a hydraulic system configured to move the implement. The hydraulic system may include a source of pressurized fluid; a tank; a hydraulic cylinder operatively coupled to the implement, the hydraulic cylinder including a head end and a rod end; a first independent metering valve disposed between and fluidly connected to the source, the tank, and the head end of the hydraulic cylinder; and a second independent metering valve disposed between and fluidly connected to the source, the tank, and the rod end of the hydraulic cylinder. Each of the first independent metering valve and the second independent metering valve may include a straight-stemmed spool and a valve actuator disposed on one side of the spool. The valve actuator may include a push coil configured to push the spool in a first direction, a pull coil configured to pull the spool in a second direction opposite the first direction, and a force feedback mechanism configured to balance a force of the push coil and the pull coil.

The hydraulic system may further include a first relief valve disposed between and fluidly connected to the first independent metering valve, the tank, and the head end of the hydraulic cylinder and a second relief valve disposed between and fluidly connected to the second independent metering valve, the tank, and the rod end of the hydraulic cylinder. Each of the first relief valve and the second relief valve may be configured to limit a pressure of the pressurized fluid. The hydraulic system may also include a drift reduction valve disposed between the first independent metering valve and the head end of the hydraulic cylinder, and an internal regeneration valve disposed between and fluidly connected to the head end and the rod end of the hydraulic cylinder. The drift reduction valve may be configured to reduce drift of the hydraulic cylinder. The internal regeneration valve may be configured to regenerate a flow from the rod end of the hydraulic cylinder to join a flow into the head end of the hydraulic cylinder.

In accordance with yet another aspect, a hydraulic system is disclosed. The hydraulic system may include a source of pressurized fluid; a tank; a hydraulic actuator including a first chamber and a second chamber; a first independent metering valve disposed between and fluidly connected to the source, the tank, and the first chamber of the hydraulic actuator; a second independent metering valve disposed between and fluidly connected to the source, the tank, and the second chamber of the hydraulic actuator; a selector valve disposed between and fluidly connected to the tank, the first independent metering valve, and the second independent metering valve; a first pressure reducing valve (PRV); a second PRV; and a third PRV. Each of the first PRV, the second PRV, and the third PRV may be disposed between and fluidly connected to a pilot source and the selector valve.

The first PRV, the second PRV, the third PRV, and the selector valve may be configured to actuate the first independent metering valve and the second independent metering valve.

While the present disclosure is susceptible to various modifications and alternative constructions, certain illustrative embodiments thereof will be shown and described below in detail. The disclosure is not limited to the specific embodiments disclosed, but instead includes all modifications, alternative constructions, and equivalents thereof.

DETAILED DESCRIPTION

Figure 1:
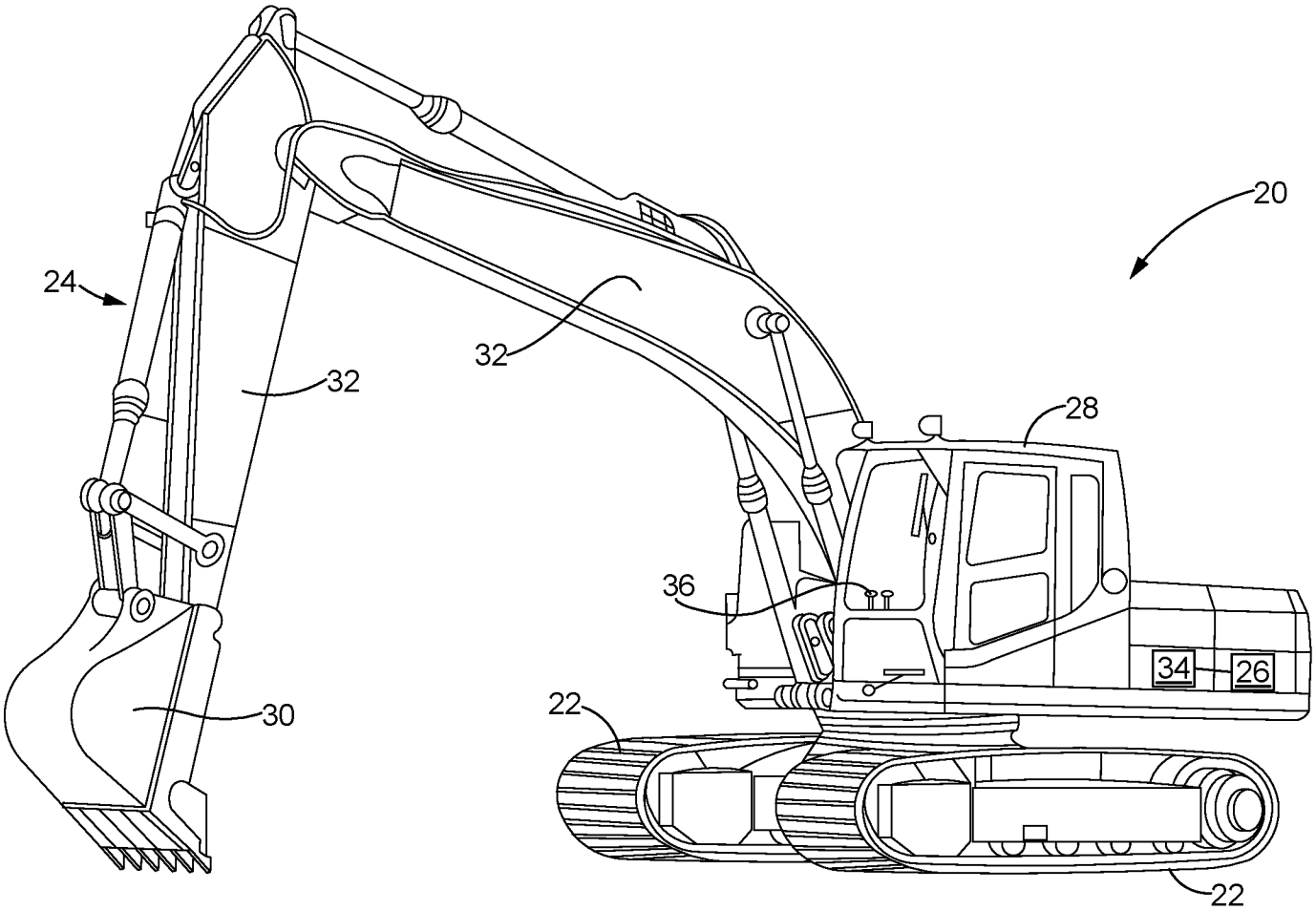
FIG. 1 is a perspective view of a machine, according to one aspect.

Referring now to the drawings, and with specific reference to FIG. 1, a machine consistent with certain embodiments of the present disclosure is generally referred to by reference numeral 20. Generally, corresponding reference numbers will be used throughout the drawings to refer to the same or corresponding parts. It is to be understood that although the machine 20 is illustrated as a hydraulic excavator, the machine 20 may be of many other types. As used herein, the term "machine" refers to a mobile machine that performs a driven operation involving physical movement associated with a particular industry, such as, earthmoving, construction, landscaping, forestry, transportation, agriculture, mining, etc.

Non-limiting examples of machines include commercial and industrial machines, such as, excavators, loaders, earthmoving vehicles, dozers, motor graders, tractors, backhoes, trucks, mining vehicles, on-highway vehicles, trains, agricultural equipment, material handling equipment, and other types of machines that operate in a work environment. It is to be understood that the machine 20 is shown primarily for illustrative purposes to assist in disclosing features of various embodiments, and that FIG. 1 does not depict all of the components of a machine.

The machine 20 may include traction devices 22, an implement assembly 24, an engine 26 or other power source, and an operator cab 28. Although traction devices 22 are shown as tracks, traction devices 22 may be wheels or of any other type. The implement assembly 24 may include a bucket 30, or other implement, mounted to one or more linkages 32. The engine 26 may provide mechanical power to a hydraulic system 34, which is configured to drive and control the traction devices 22 and the implement assembly 24. The operator cab 28 may contain an operator interface 36, which may be configured to receive input from and output data to an operator of the machine 20. The operator interface 36 may include a plurality of operator controls, such as joysticks and levers, for controlling operation of the machine 20 and manipulating the implement assembly 24.

Figure 2:
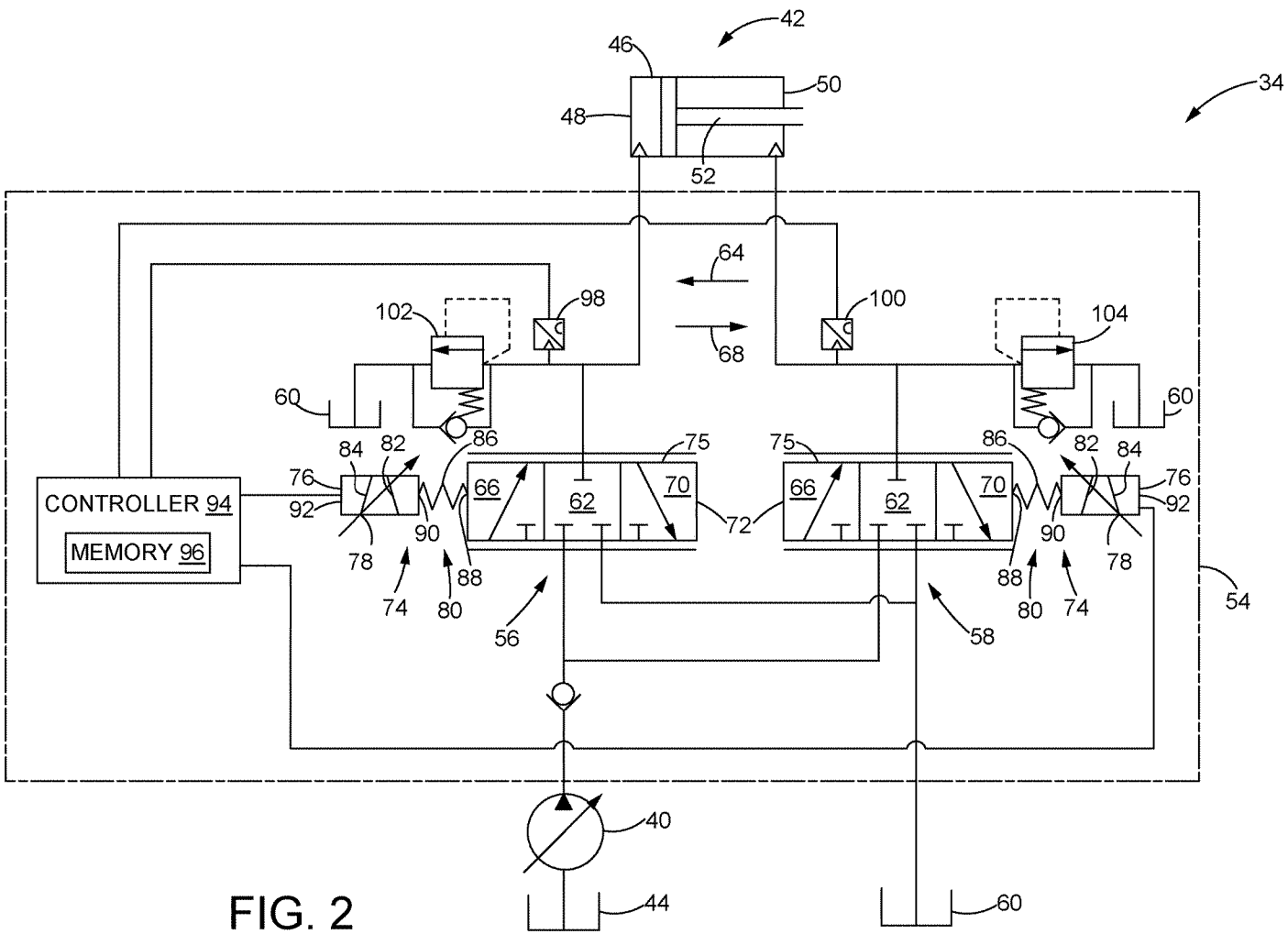
FIG. 2 is a schematic view of a hydraulic system of the machine of FIG. 1, in accordance with another aspect.

Referring now to FIG. 2, with continued reference to FIG. 1, The hydraulic system 34 may include a pump 40, or other source of pressurized fluid, in operative fluid communication with at least one hydraulic actuator 42. The pump 40 may be configured to convert mechanical power from the engine 26 into hydraulic power. For example, the pump 40 may draw hydraulic fluid from a reservoir or hydraulic tank 44 in order to generate a pressurized flow to the hydraulic actuator 42.

The hydraulic actuator 42 may comprise a cylinder 46 with one or more fluid chambers 48, 50 disposed on opposite sides of a piston 52, or other movable element, disposed therein. For instance, the hydraulic actuator 42 may include a head end, or the first chamber 48, and a rod end, or the second chamber 50. The pump 40 may provide a pressurized hydraulic fluid to the first chamber 48 and the second chamber 50 of the hydraulic actuator 42. The piston 52 may be operatively coupled to the implement assembly 24, such as to the linkages 32 or the bucket 30. A pressure differential of the pressurized fluid between the first chamber 48 and the second chamber 50 may cause the piston 52 to move, thereby moving the implement assembly 24.

The hydraulic system 34 may further include an electrohydraulic valve arrangement 54 configured to selectively connect the pump 40 with the first chamber 48 and/or the second chamber 50 of the hydraulic actuator 42. The electrohydraulic valve arrangement 54 may include a first independent metering valve (IMV) 56 and a second IMV 58. The first IMV 56 may be disposed between and fluidly connected to the pump 40, a drain 60, and the first chamber 48 of the hydraulic actuator 42. The second IMV 58 may be disposed between and fluidly connected to the pump 40, the drain 60, and the second chamber 50 of the hydraulic actuator 42. The drain 60 may be fluidly connected to the tank 44.

Each of the first IMV 56 and the second IMV 58 may comprise an electrohydraulic proportional solenoid valve. For instance, each of the first IMV 56 and the second IMV 58 may comprise a 3-state bidirectional electrohydraulic valve. More specifically, each of the first IMV 56 and the second IMV 58 may be biased in a first state 62, which is a neutral position, and may be hydraulically actuated to move in a first direction (denoted by arrow 64) to a second state 66 and in a second direction (denoted by arrow 68), opposite the first direction, to a third state 70. In the first state 62, or the neutral position, the chambers 48, 50 are not connected to either the pump 40 or the drain 60.

When the first IMV 56 is moved in the first direction to the second state 66, the first chamber 48 of the hydraulic actuator 42 is connected to the pump 40. When the first IMV 56 is moved in the second direction to the third state 70, the first chamber 48 is connected to the drain 60. Likewise, when the second IMV 58 is moved in the first direction to the second state 66, the second chamber 50 of the hydraulic actuator 42 is connected to the pump 40. When the second IMV 58 is moved in the second direction to the third state 70, the second chamber 50 is connected to the drain 60.

Furthermore, each of the first IMV 56 and the second IMV 58 may be hydraulically actuated. For example, each of the first IMV 56 and the second IMV 58 may include a spool 72 and a valve actuator 74 disposed on one side of the spool 72. The spool 72 may include a straight stem 75, such as opposed to a check stem. The valve actuator 74 may comprise a cartridge valve 76 including a solenoid 78 and a force feedback mechanism 80. The solenoid 78 may include a push coil 82 configured to push the spool 72 in the first direction (denoted by arrow 64) and a pull coil 84 configured to pull the spool 72 in the second direction (denoted by arrow 68) in order to move each IMV 56, 58 to the second state 66 and third state 70, respectively.

In addition, the valve actuator 74 may provide compensation functionality via the force feedback mechanism 80 in order to ensure consistent pressure to the hydraulic actuator 42. Configured to balance a force of the push coil 82 and the pull coil 84, the force feedback mechanism 80 of the valve actuator 74 may comprise a feedback spring 86 disposed on one side of the spool 72. For instance, one end 88 of the feedback spring 86 may be adjacent and/or connected to the spool 72 of the IMV 56, 58, while an opposite end 90 of the feedback spring 86 may be adjacent and/or connected to a pilot spool 92 of the cartridge valve 76. The force feedback mechanism 80 may provide internal force feedback and keep the cartridge valve 76 in equilibrium in a neutral state. In so doing, the valve actuator 74 may precisely control a position of the spool 72 of each IMV 56, 58, as well as provide quick actuation of each IMV 56, 58.

The electrohydraulic valve arrangement 54 of the hydraulic system 34 may further include a controller 94 in operative communication with each of the first IMV 56 and the second IMV 58. The controller 94 may be implemented using one or more of a processor, a microprocessor, a microcontroller, a digital signal processor (DSP), a field-programmable gate array (FPGA), an electronic control module (ECM), an electronic control unit (ECU), and a processor-based device that may include or be associated with a non-transitory computer readable storage medium having stored thereon computer-executable instructions, or any other suitable means for electronically controlling functionality of the hydraulic system 34.

The controller 94 may be configured to operate according to predetermined algorithms or sets of instructions for operating the hydraulic system 34. Such algorithms or sets of instructions may be programmed or incorporated into a memory 96 that is associated with or at least accessible to the controller 94. The memory 96 may be provided within and/or external to the controller 94, and may comprise a non-volatile memory. It is understood that the controller 94 may include other hardware, software, firmware, and combinations thereof.

More specifically, the controller 94 may be in electronic communication with each of the valve actuators 74 of the first IMV 56 and the second IMV 58. For instance, the controller 94 may be operatively connected to the solenoids 78 of the valve actuators 74. The controller 94 may send signals to the valve actuators 74 indicative of a displacement for each of the spools 72 of the first IMV 56 and the second IMV 58. The signals sent by the controller 94 may correspond to an amount of current that is proportional to the displacement for each of the spools 72, thereby providing infinite opening positions for each of the first IMV 56 and the second IMV 58.

The controller 94 may generate the amount of current to send to the solenoids 78 of the valve actuators 74 based on signals received from the operator interface 36, such as from operator controls for manipulating the implement assembly 24. The amount of current generated by the controller 94 may also be based on predetermined algorithms preprogrammed into the memory 96. Furthermore, independent metering of pressurized fluid to the first chamber 48 and the second chamber 50 of the hydraulic actuator 42 may be achieved via the first IMV 56 and the second IMV 58.

More specifically, due to the split spool configuration of the electrohydraulic valve arrangement 54, each of the first IMV 56 and the second IMV 58 may be controlled separately and independently. For example, the controller 94 may be configured to send signals to each hydraulic actuator 42 of the first IMV 56 and the second IMV 58 to cause actuation wherein when the first chamber 48 is connected to the pump 40, the second chamber 50 is connected to the drain 60, and vice-versa. In this example, the controller 94 may be configured to move the second IMV 58 to the third state 70 when the first IMV 56 is in the second state 66, and move the first IMV 56 to the third state 70 when the second IMV 58 is in the second state 66.

The electrohydraulic valve arrangement 54 of the hydraulic system 34 may further include at least one pressure sensor 98, 100 configured to detect a pressure of the pressurized fluid going into and out of the first chamber 48 and the second chamber 50 of the hydraulic actuator 42. The controller 94 may be in communication with the at least one pressure sensor 98, 100 in order to determine the opening positions for each of the first IMV 56 and the second IMV 58. For example, a first sensor 98 may be disposed between the first IMV 56 and the first chamber 48 of the hydraulic actuator 42, and a second sensor 100 may be disposed between the second IMV 58 and the second chamber 50 of the hydraulic actuator 42. However, other configurations for the at least one pressure sensor 98, 100 may be used.

In addition, the electrohydraulic valve arrangement 54 may include at least one relief valve 102, 104 configured to limit a pressure of the pressurized fluid going into the first chamber 48 and the second chamber 50 of the hydraulic actuator 42. For instance, a first relief valve 102 may be disposed between and fluidly connected to the first IMV 56, the drain 60, and the first chamber 48 of the hydraulic actuator 42. A second relief valve 104 may be disposed between and fluidly connected to the second IMV 58, the drain 60, and the second chamber 50 of the hydraulic actuator 42. However, other configurations for the at least one relief valve 102, 104 may be used.

Figure 3:
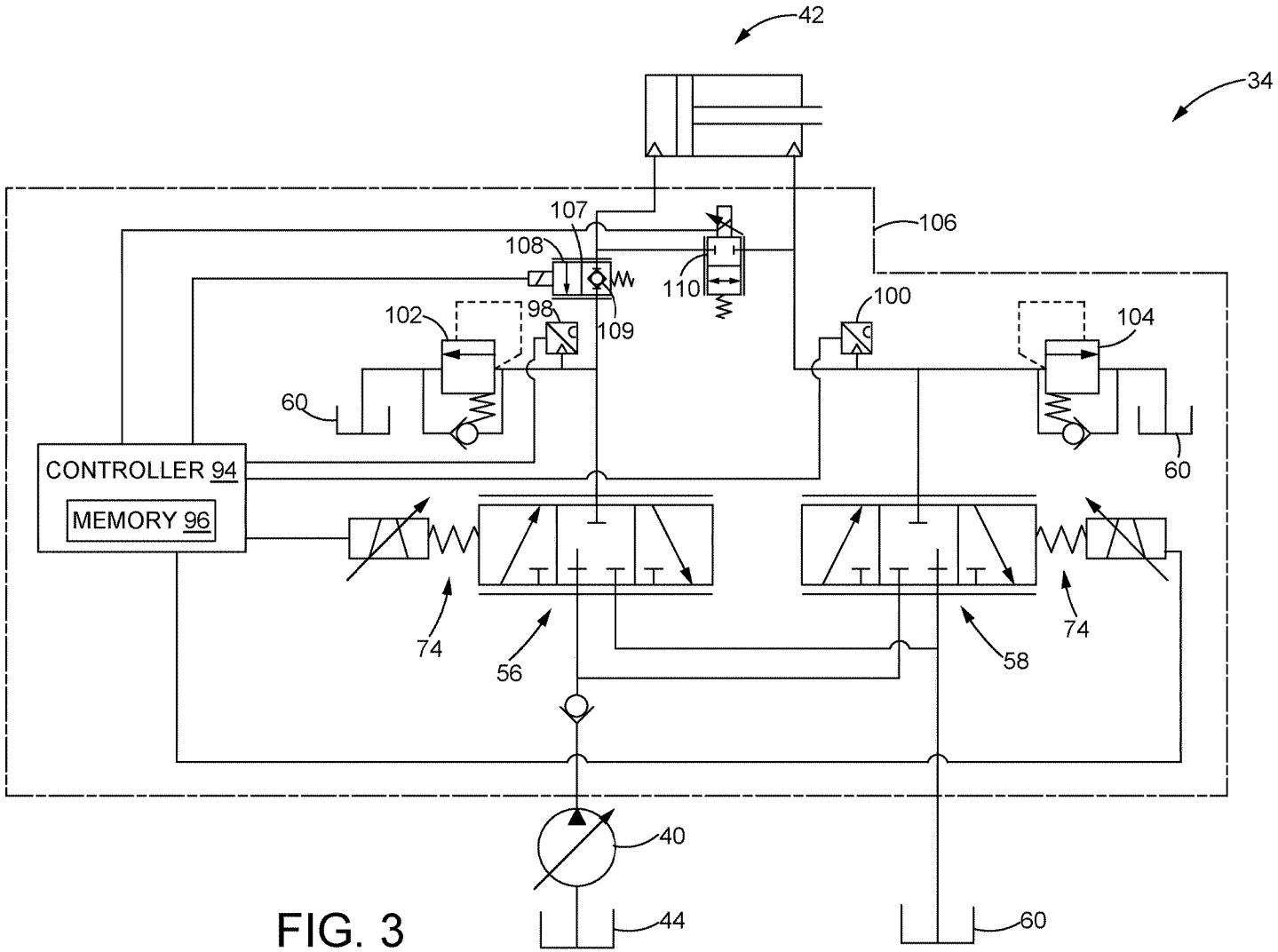
FIG. 3 is a schematic view of another hydraulic system of the machine of FIG. 1, in accordance with another aspect.

Turning now to FIG. 3, with continued reference to FIGS. 1 and 2, an electrohydraulic valve arrangement 106 may further include a drift reduction valve 108 configured to reduce drift of the hydraulic actuator 42. For example, the drift reduction valve 108 may be in communication with the controller 94 and may comprise an electrohydraulic valve including a stem having a poppet sealing surface 109. The drift reduction valve 108 may lock the cylinder 46 of the hydraulic actuator 42 in order to help prevent leakage.

The drift reduction valve 108 may be disposed between and fluidly connected to the first IMV 56 and the first chamber 48 of the hydraulic actuator 42. For instance, the drift reduction valve 108 may comprise an on-off poppet valve 107 with the poppet sealing surface 109. In addition, the drift reduction valve 108 may be electrical or may be pilot operated. However, other configurations for the drift reduction valve 108 may be used.

The electrohydraulic valve arrangement 106 may also include an internal regeneration valve 110 configured to regenerate a flow from the second chamber 50 of the hydraulic actuator 42 to join a flow into the first chamber 48 of the hydraulic actuator 42, and vice versa. The internal regeneration valve 110 may reduce pump flow, while increasing a flow to the hydraulic actuator 42. In communication with the controller 94, the internal regeneration valve 110 may comprise a 2-state electrohydraulic proportional valve disposed between and fluidly connected to the first chamber 48 and the second chamber 50 of the hydraulic actuator 42. However, other configurations for the internal regeneration valve 110 may be used.

Figure 4:
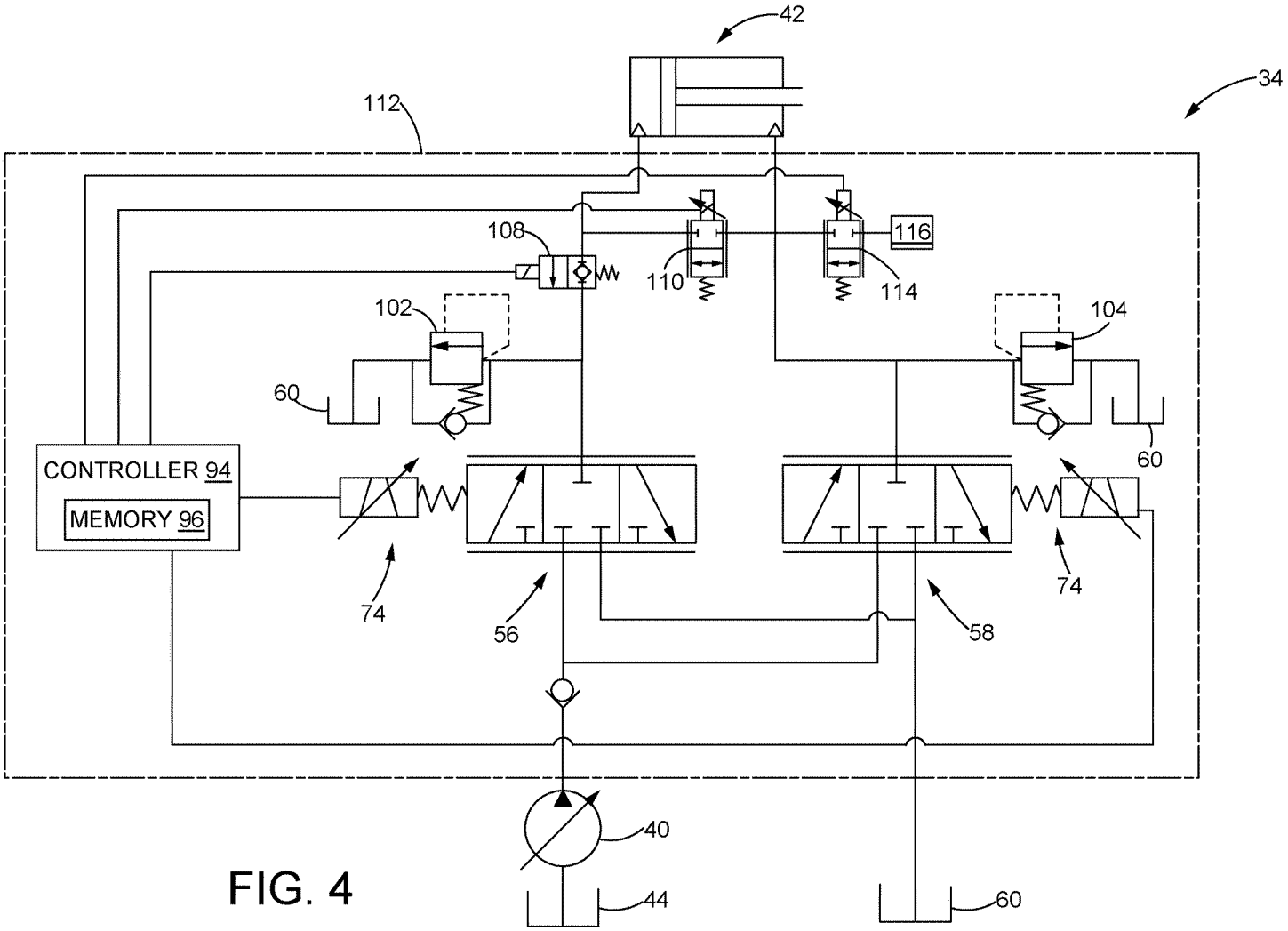
FIG. 4 is a schematic view of another hydraulic system of the machine of FIG. 1, in accordance with another aspect.

Referring now to FIG. 4, with continued reference to FIGS. 1-3, an electrohydraulic valve arrangement 112 may further include a circuit-to-circuit regeneration valve 114 configured to regenerate the flow from the second chamber 50 of the hydraulic actuator 42 to join a flow into a second hydraulic circuit 116. The second hydraulic circuit 116 may include a second hydraulic actuator, and the flow from the second chamber 50 of the first hydraulic actuator 42 may be routed to join a flow into a first chamber of the second hydraulic actuator. In communication with the controller 94, the circuit-to-circuit regeneration valve 114 may comprise a 2-state electrohydraulic proportional valve disposed between and fluidly connected to the second chamber 50 of the hydraulic actuator 42 and the second hydraulic circuit 116, although other configurations may be used.

By regenerating flow from the hydraulic actuator 42 to itself and/or to other circuits, increased flow to the hydraulic actuator(s) may be accomplished with a same or reduced flow from the pump 40. In so doing, the hydraulic system 34 may experience improved efficiency and productivity. Furthermore, a hydro-mechanical pressure compensator may not be necessary, thereby eliminating a cost of the pressure compensator and providing a more cost-effective solution.

Figure 5:
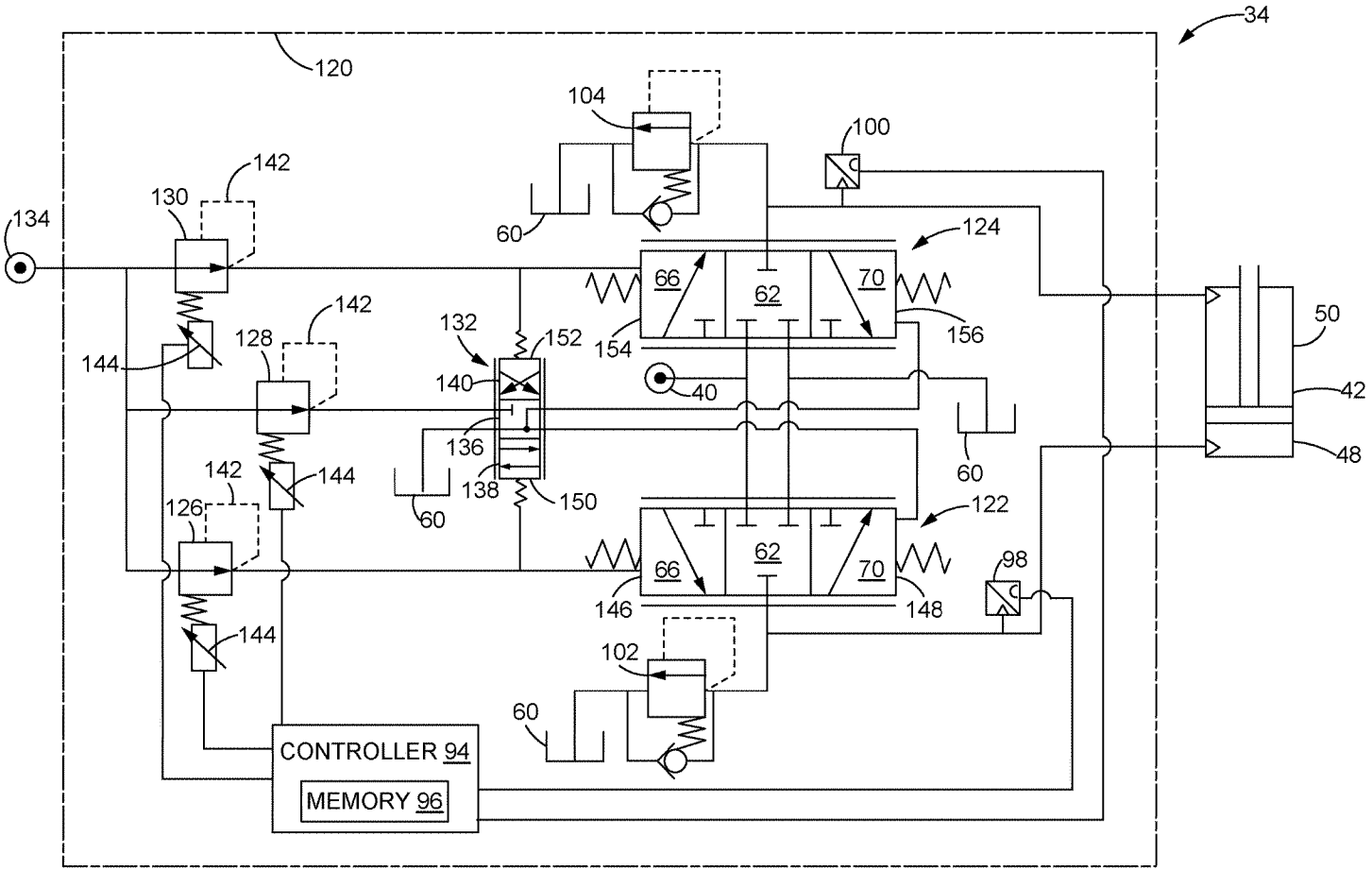
FIG. 5 is a schematic view of another hydraulic system of the machine of FIG. 1, in accordance with another aspect.

Turning now to FIG. 5, with continued reference to FIGS. 1-4, an electrohydraulic valve arrangement 120 of the hydraulic system 34 may include a first IMV 122 and a second IMV 124. The first IMV 122 and the second IMV 124 may be similar to the first IMV 56 and the second IMV 58, respectively. Each of the first IMV 122 and the second IMV 124 may comprise 3-state bidirectional, electrohydraulic proportional solenoid valves biased in the first state 62, or the neutral position. However, instead of the valve actuator 74 in the examples of FIGS. 2-4, each of the first IMV 122 and the second IMV 124 may be hydraulically actuated by pressure reducing valves 126, 128, 130 and a selector valve 132.

More specifically, a first pressure reducing valve (PRV) 126 may be disposed between and fluidly connected to a pilot source 134, the first IMV 122, and the selector valve 132. A second PRV 128 may be disposed between and fluidly connected to the pilot source 134 and the selector valve 132. A third PRV 130 may be disposed between and fluidly connected to the pilot source 134, the second IMV 124, and the selector valve 132. Each of the first PRV 126, the second PRV 128, and the third PRV 130 may comprise a 3-state electrohydraulic proportional PRV, although other configurations may be used.

The selector valve 132 may comprise a 3-state hydro-mechanical valve biased in a first state 136, or a neutral position. The pilot source 134 may comprise a separate pump from the pump 40, or other source of pressurized fluid. In another aspect, the pilot source 134 may be the pump 40. However, other configurations for the selector valve 132 and the pilot source 134 may be used.

Furthermore, each of the first PRV 126, the second PRV 128, and the third PRV 130 may include a pressure feedback loop 142 to provide proportional control of an output pressure of the pressurized fluid flowing through each PRV 126, 128, 130. The controller 94 may be in electronic communication with each of the first PRV 126, the second PRV 128, and the third PRV 130. Each PRV 126, 128, 130 may regulate flow to actuate the first IMV 122 and the second IMV 124 based on signals from the controller 94, with an opening of each PRV 126, 128, 130 being proportional to an amount of current sent to a solenoid 144 of each PRV 126, 128, 130.

For example, in order to connect the first chamber 48 of the hydraulic actuator 42 to the pump 40, the controller 94 may be configured to energize the first PRV 126 such that pressurized fluid from the pilot source 134 flows to a first end 146 of the first IMV 122 and to a first end 150 of the selector valve 132. In so doing, the first IMV 122 may be hydraulically actuated to move to the second state 66, thereby connecting the first chamber 48 of the hydraulic actuator 42 to the pump 40. Moreover, when pressurized fluid from the pilot source 134 flows to the first end 150 of the selector valve 132, the selector valve 132 may be hydraulically actuated to move to a second state 138.

In addition, the controller 94 may be configured to energize the second PRV 128 such that when the selector valve 132 is in the second state 138, pressurized fluid from the pilot source 134 flows to a second end 156 of the second IMV 124. In so doing, the second IMV 124 may be hydraulically actuated to move to the third state 70. With the second IMV 124 in the third state 70, the second chamber 50 of the hydraulic actuator 42 may be connected to the drain 60.

In order to connect the second chamber 50 of the hydraulic actuator 42 to the pump 40, the controller 94 may be configured to energize the third PRV 130 such that pressurized fluid from the pilot source 134 flows to a first end 154 of the second IMV 124 and to a second end 152 of the selector valve 132. In so doing, the second IMV 124 may be hydraulically actuated to move to the second state 66, thereby connecting the second chamber 50 of the hydraulic actuator 42 to the pump 40. Moreover, when pressurized fluid from the pilot source 134 flows to the second end 152 of the selector valve 132, the selector valve 132 may be hydraulically actuated to move to a third state 140.

In addition, the controller 94 may be configured to energize the second PRV 128 such that when the selector valve 132 is in the third state 140, pressurized fluid from the pilot source 134 flows to a second end 148 of the first IMV 122. In so doing, the first IMV 122 may be hydraulically actuated to move to the third state 70. With the first IMV 122 in the third state 70, the first chamber 48 of the hydraulic actuator 42 may be connected to the drain 60.

The electrohydraulic valve arrangement 120 may further include at least one relief valve 102, 104 and at least one pressure sensor 98, 100. For instance, the first relief valve 102 may be disposed between and fluidly connected to the first IMV 122, the drain 60, and the first chamber 48 of the hydraulic actuator 42, while the second relief valve 104 may be disposed between and fluidly connected to the second IMV 124, the drain 60, and the second chamber 50 of the hydraulic actuator 42. In communication with the controller 94, the first sensor 98 may be disposed between the first IMV 122 and the first chamber 48 of the hydraulic actuator 42, and the second sensor 100 may be disposed between the second IMV 124 and the second chamber 50 of the hydraulic actuator 42. However, other configurations for the at least one relief valve 102, 104 and the at least one pressure sensor 98, 100 may be used.

Figure 6:
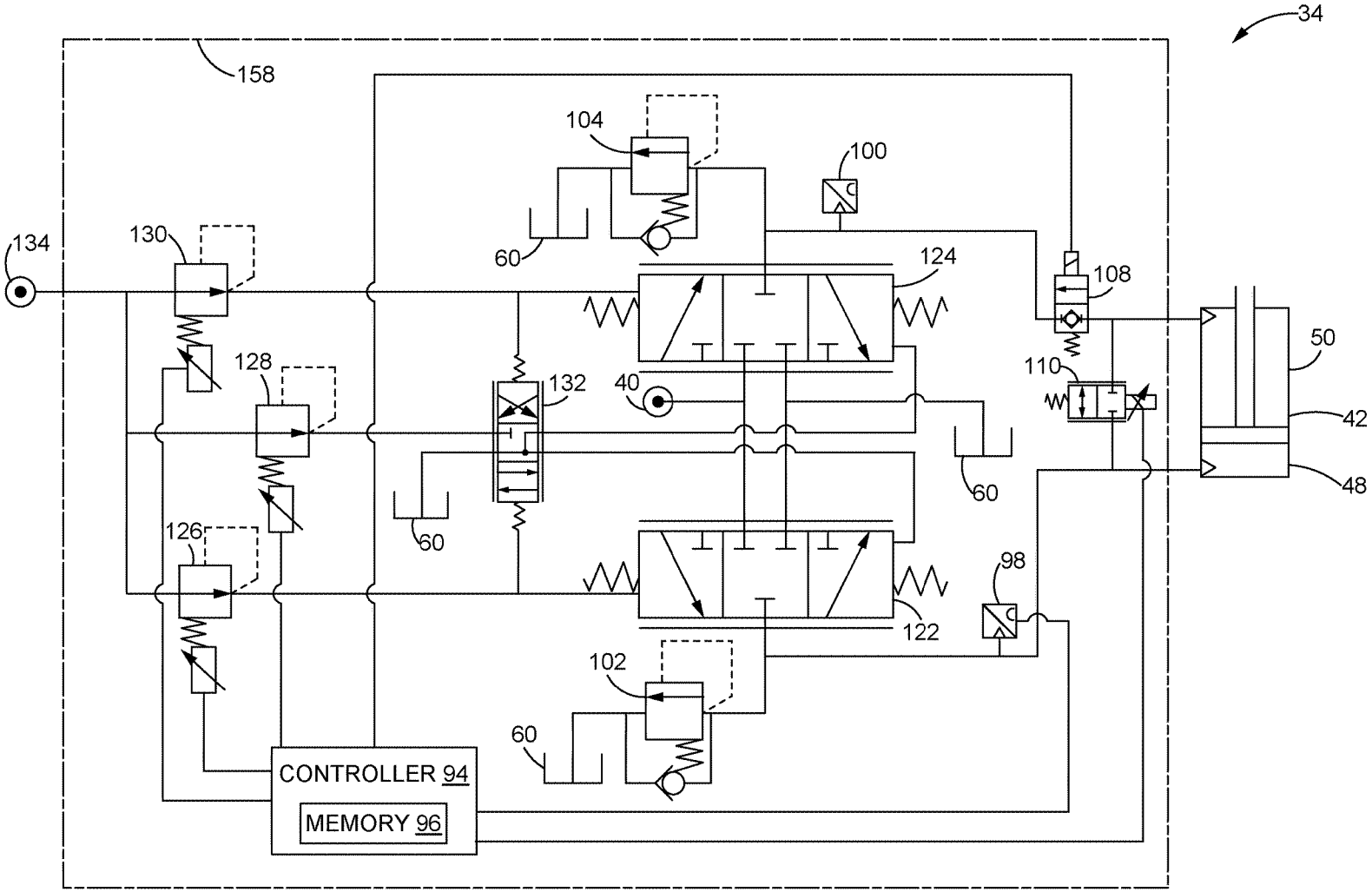
FIG. 6 is a schematic view of another hydraulic system of the machine of FIG. 1, in accordance with another aspect.

Referring now to FIG. 6, with continued reference to FIGS. 1-5, an electrohydraulic valve arrangement 158 may further include the drift reduction valve 108 and the internal regeneration valve 110 in addition to the split spool configuration with the first PRV 126, the second PRV 128, the third PRV 130, and the selector valve 132. For example, the drift reduction valve 108 may be disposed between and fluidly connected to the first IMV 122 and the first chamber 48 of the hydraulic actuator 42. The internal regeneration valve 110 may be disposed between and fluidly connected to the first chamber 48 and the second chamber 50 of the hydraulic actuator 42. However, other configurations for drift reduction valve 108 and the internal regeneration valve 110 may be used. Furthermore, although not shown in FIG. 6, the electrohydraulic valve arrangement 120 may further include the circuit-to-circuit regeneration valve 114 disposed between and fluidly connected to the second chamber 50 of the hydraulic actuator 42 and the second hydraulic circuit 116.

INDUSTRIAL APPLICABILITY

In general, the foregoing disclosure finds utility in various industrial applications, such as, in earthmoving, construction, industrial, agricultural, mining, transportation, and forestry machines. In particular, the disclosed hydraulic system may be applied to excavators, loaders, earth-moving vehicles, dozers, motor graders, tractors, backhoes, trucks, mining vehicles, on-highway vehicles, trains, agricultural equipment, material handling equipment, and the like.

By applying the disclosed electrohydraulic valve arrangements to hydraulic systems, independent metering of the head end and rod end chambers of a hydraulic cylinder and/or motor may be accomplished in a cost-effective and efficient manner. More specifically, the disclosed electrohydraulic valve arrangements each provide a split spool configuration, or two spool configuration, wherein one spool controls the head end chamber and the other spool controls the rod end chamber. Furthermore, each of the spools is hydraulically actuated by a valve actuator having a push/pull solenoid on one end of each spool, as well as internal force feedback to accurately and responsively position each spool. In another aspect, the split spool configuration is actuated by pressure reducing valves (PRVs) which do not need to be placed directly adjacent to the spools, thereby providing for a flexible arrangement of parts within the physical space of the machine.

The spools of the disclosed electrohydraulic arrangements are straight-stemmed, thereby reducing costs of production and manufacturing. Moreover, the disclosed split spool configuration, with either push/pull actuation or PRV actuation, includes drift reduction, as well as internal and circuit-to-circuit regeneration. This may result in a less costly electrohydraulic arrangement because a hydro-mechanical pressure compensator is not needed, thereby providing an arrangement with less components and complexity. At a same time, the disclosed electrohydraulic arrangements may provide a more versatile, productive, and efficient hydraulic system, along with the split spool configuration benefits of independent metering, active ride control, lift and pump separation, dig regeneration, and smart boom.

While the foregoing detailed description has been given and provided with respect to certain specific embodiments, it is to be understood that the scope of the disclosure should not be limited to such embodiments, but that the same are provided simply for enablement and best mode purposes. The breadth and spirit of the present disclosure is broader than the embodiments specifically disclosed and encompassed within the claims appended hereto. Moreover, while some features are described in conjunction with certain specific embodiments, these features are not limited to use with only the embodiment with which they are described, but instead may be used together with or separate from, other features disclosed in conjunction with alternate embodiments.

What is claimed is:

1. A hydraulic system, comprising:

a source of pressurized fluid;

a tank;

a hydraulic actuator including a first chamber and a second chamber;

a first independent metering valve disposed between and fluidly connected to the source, the tank, and the first chamber of the hydraulic actuator; and a second independent metering valve disposed between and fluidly connected to the source, the tank, and the second chamber of the hydraulic actuator, each of the first independent metering valve and the second independent metering valve including a spool and a valve actuator disposed on one side of the spool, the valve actuator including a push coil configured to push the spool in a first direction, a pull coil configured to pull the spool in a second direction opposite the first direction, and a force feedback mechanism configured to balance a force of the push coil and the pull coil.

2. The hydraulic system of claim 1, wherein each of the spools of the first independent metering valve and the second independent metering valve include a straight stem.

3. The hydraulic system of claim 1, wherein each of the first independent metering valve and the second independent metering valve comprises an electrohydraulic proportional solenoid valve.

4. The hydraulic system of claim 1, further comprising a first sensor disposed between the first independent metering valve and the hydraulic actuator, and a second sensor disposed between the second independent metering valve and the hydraulic actuator, each of the first sensor and the second sensor configured to detect a pressure of the pressurized fluid.

5. The hydraulic system of claim 1, further comprising a first relief valve disposed between and fluidly connected to the first independent metering valve, the tank, and the hydraulic actuator, and a second relief valve disposed between and fluidly connected to the second independent metering valve, the tank, and the hydraulic actuator, each of the first relief valve and the second relief valve configured to limit a pressure of the pressurized fluid.

6. The hydraulic system of claim 1, further comprising a drift reduction valve including a stem having a poppet sealing surface, the drift reduction valve being disposed between the first independent metering valve and the hydraulic actuator, the drift reduction valve configured to reduce drift of the hydraulic actuator by locking a cylinder of the hydraulic actuator.

7. The hydraulic system of claim 6, further comprising an internal regeneration valve fluidly connected to the first chamber and the second chamber of the hydraulic actuator, the internal regeneration valve configured to regenerate a flow from the second chamber to join a flow into the first chamber.

8. The hydraulic system of claim 7, further comprising a circuit-to-circuit regeneration valve fluidly connected to the second chamber of the hydraulic actuator and a second hydraulic circuit, the circuit-to-circuit regeneration valve configured to regenerate the flow from the second chamber to join a flow into the second hydraulic circuit.

9. The hydraulic system of claim 8, without a hydro-mechanical pressure compensator.

10. The hydraulic system of claim 9, farther comprising a controller itt communication with each of the valve actuators of the first independent metering valve and the second independent metering valve, the controller configured to send signals to the valve actuators indicative of a displacement for each of the spools of the first independent metering valve and the second independent metering valve.

11. A machine, comprising:

an implement; and a hydraulic system configured to move the implement, the hydraulic system including:

a source of pressurized fluid, a tank, a hydraulic cylinder operatively coupled to the implement, the hydraulic cylinder including a head end and a rod end, a first independent metering valve disposed between and fluidly connected to the source, the tank, and the head end of the hydraulic cylinder, a second independent metering valve disposed between and fluidly connected to the source, the tank, and the rod end of the hydraulic cylinder, each of the first independent metering valve and the second independent metering valve including a straight-stemmed spool and a valve actuator disposed on one side of the spool, the valve actuator including a push coil configured to push the spool in a first direction, a pull coil configured to pull the spool, in a second direction opposite the first direction, and a force feedback mechanism configured to balance a force of the push coil and the pull coil, a first relief valve disposed between and fluidly connected to the first independent metering, valve, the tank, and the head end of the hydraulic cylinder, a second relief valve disposed between and fluidly connected to the second independent metering valve, the tank, and the rod end of the hydraulic cylinder, each of the first relief valve and the second relief valve configured to limit a pressure of the pressurized fluid, a drift reduction valve disposed between the first independent metering valve and the head end of the hydraulic cylinder, the drift reduction valve configured to reduce drift of the hydraulic cylinder, and an internal regeneration valve disposed between and fluidly connected to the head end and the rod end of the hydraulic cylinder, the internal regeneration valve configured to regenerate a flow from the rod end of the hydraulic cylinder to join a flow into the head end of the hydraulic cylinder.

12. The machine of claim 11, wherein each of the first independent metering valve and the second independent metering valve comprises an electrohydraulic proportional solenoid valve.

13. The machine of claim 12, wherein each of the first independent metering valve and the second independent metering valve is a bidirectional valve.

14. The machine of claim 13, wherein the hydraulic system further includes a first sensor disposed between the first independent metering valve and the drift reduction valve, and a second sensor disposed between the second independent metering valve and the rod end of the hydraulic cylinder, each of the first sensor and the second sensor configured to detect a pressure of the pressurized fluid.

15. The machine of claim 14, wherein the hydraulic system further includes a circuit-to-circuit regeneration valve fluidly connected to the rod end of the hydraulic cylinder and a second hydraulic circuit, the circuit-to-circuit regeneration valve configured to regenerate the flow from the rod end of the hydraulic cylinder to join a flow into the second hydraulic circuit.

16. A hydraulic system, comprising:

a source of pressurized fluid;

a tank;

a hydraulic actuator including a first chamber and a second chamber;

a first independent metering valve disposed between and fluidly connected to the source, the tank, and the first chamber of the hydraulic actuator;

a second independent metering valve disposed between and fluidly connected to the source, the tank, and the second chamber of the hydraulic actuator;

a selector valve disposed between and fluidly connected to the tank, the first independent metering valve, and the second independent metering valve;

a first pressure reducing valve (PRV);

a second PRV; and a third PRV, each of the first PRV, the second PRV, and the third PRV disposed between and fluidly connected to a pilot source and the selector valve, wherein the first PRV, the second PRV, the third PRV, and the selector valve are configured to actuate the first independent metering valve and the second independent metering valve.

17. The hydraulic system of claim 16, further comprising:

a first sensor disposed between the first independent metering valve and the hydraulic actuator, and a second sensor disposed between the second independent metering valve and the hydraulic actuator, each of the first, sensor and the second sensor configured to detect a pressure of the pressurized fluid;

a first relief valve disposed between and fluidly connected to the first independent metering valve, the tank, and the hydraulic actuator, and a second relief valve disposed between and fluidly connected to the second independent metering valve, the tank, and the hydraulic actuator, each of the first relief valve and the second relief valve configured to limit a pressure of the pressurized fluid;

a drift reduction valve disposed between the first independent metering valve and the hydraulic actuator, the drift reduction valve configured to reduce drift of the hydraulic actuator; and an internal regeneration valve fluidly connected to the first chamber and the second chamber of the hydraulic actuator, the internal regeneration valve configured to regenerate flow from the second chamber to join flow into the first chamber.

18. The hydraulic system of claim 16, wherein the first PRV, the second PRV, the third PRV comprise a 3-state electrohydraulic proportional PRV.

19. The hydraulic system of claim 18, wherein the selector valve comprises a 3-state hydro-mechanical valve.

20. The hydraulic system of claim 19, wherein actuation of the first independent metering valve and the second independent metering valve comprises:

energizing the first PRV to hydraulically actuate the first independent metering valve to connect the first chamber to the source of pressurized fluid; and hydraulically actuating the selector valve and energizing the second PRV to actuate the second independent metering valve to connect the second chamber to a drain.

* * * * *